US005927528A

United States Patent [19]

Jones

[11] Patent Number: 5,927,528

[45] **Date of Patent: *Jul. 27, 1999**

[54] MEDICATION CONTAINER WITH IMPROVED SEALING BETWEEN CAP LINER AND CONTAINER BODY

[76] Inventor: William Thomas Jones, 38 Redford Road, London, Ontario, Canada, N3X 3V5

[ * ] Notice: This patent is subject to a terminal disclaimer.

[21] Appl. No.: 09/076,802

[22] Filed: May 13, 1998

Related U.S. Application Data

[63] Continuation-in-part of application No. 09/035,090, Mar. 5, 1998, which is a continuation-in-part of application No. 08/812,835, Mar. 6, 1997, Pat. No. 5,819,968.

[51] Int. Cl.[6] ..... B65D 55/02

[52] U.S. Cl. ..... 215/222; 215/230; 215/332; 116/309

[58] Field of Search ..... 215/204, 214, 215/216–220, 222–225, 230, 274, 276, 277, 332, 349–351, 11.1, 11.3, 11.6, 343–346, 301, 342, DIG. 1, 43, 45; 220/293, 281, 296, 302, 304; 116/306, 308, 309, 311, 312, 315, 318

[56] References Cited

U.S. PATENT DOCUMENTS

| | | | |
|---|---|---|---|
| 4,049,148 | 9/1977 | Suhr et al. | 215/222 X |
| 4,053,078 | 10/1977 | Herr | 215/222 |
| 4,399,920 | 8/1983 | Swartzbaugh et al. | 215/222 X |
| 4,444,327 | 4/1984 | Hedgewick | 215/222 X |
| 4,489,834 | 12/1984 | Thackrey | 116/308 |
| 4,528,933 | 7/1985 | Allen | 116/308 |
| 4,749,093 | 6/1988 | Trick | 215/220 |
| 4,753,189 | 6/1988 | Mastman et al. | 116/308 |
| 5,732,836 | 3/1998 | Barker et al. | 215/230 |
| 5,819,968 | 10/1998 | Jones | 215/222 |

*Primary Examiner*—Stephen K. Cronin
*Assistant Examiner*—Nathan Newhouse
*Attorney, Agent, or Firm*—Rogers & Scott

[57] ABSTRACT

A medication container has a tubular container body with an upper open end, a cap detachably securable to the upper end of the container body by clockwise rotation relative thereto and removable from the container body by counter clockwise rotation relative thereto, and a cap liner within the cap and having a peripheral portion engageable with the upper end of the container body to close the upper end. The cap liner rotates with the cap when the cap is rotated in one direction relative to the container body and remains stationary relative to the cap when the cap is rotated in an opposite direction relative to the container body, the cap and the cap liner having indicia which indicates the next dosage time when the cap is rotated in the opposite direction. The upper end of the container body has a laterally inwardly facing and upwardly and laterally outwardly inclined annular surface with a laterally inwardly projecting rib extending circumferentially therearound, and the cap liner has a laterally outwardly facing circumferentially extending surface engaging the circumferentially extending rib of the upper end of the container body in a sealing manner.

4 Claims, 6 Drawing Sheets

MEDICATION CONTAINER WITH IMPROVED SEALING BETWEEN CAP LINER AND CONTAINER BODY

This invention relates to medication containers, and this application is a continuation-in-part of U.S. patent application Ser. No. 09/035,090 filed Mar. 5, 1998, which is a continuation-in-part of U.S. patent application Ser. No. 08/812,835 filed Mar. 6, 1997, now U.S. Pat. No. 5,819,968 issued Oct. 13, 1998.

BACKGROUND OF THE INVENTION

It is known to provide medication containers with mechanism operated by opening and/or closure to indicate the time the next dosage of medication is to be taken, such information being especially useful for seniors with failing memories as well as of course for others. It is also becoming more necessary for medication in the container to be effectively isolated from the external atmosphere when the container is closed.

It is therefore an object of the invention to provide a medication container which has mechanism operated by opening and/or closure to indicate the next dosage time, and with which effectively isolates contained medication from the external atmosphere when the container is closed.

SUMMARY OF THE INVENTION

According to the invention, a medication container has a tubular container body with an upper open end, a cap detachably securable to the upper end of the container body by clockwise rotation relative thereto and removable from the container body by counter clockwise rotation relative thereto and, a cap liner within the cap and having a peripheral portion engageable with the upper end of the container body to close the upper end. The cap liner rotates with the cap when the cap is rotated in one direction relative to the container body and remains stationary relative to the cap when the cap is rotated in an opposite direction relative to the container body, the cap and the cap liner having indicia which indicates the next dosage time when the cap is rotated in the opposite direction. The upper end of the container body has a laterally inwardly facing and upwardly and laterally outwardly inclined annular surface with a laterally inwardly projecting rib extending circumferentially therearound, and the cap liner has a laterally outwardly facing circumferentially extending surface engaging the circumferentially extending rib of the upper end of the container body in a sealing manner.

The upper end of the container body may have a vertical annular surface immnediately below the laterally outwardly inclined surface, the vertical annular surface having a laterally inwardly projecting further rib extending circumferentially therearound, and the laterally outwardly facing circumferentially extending surface of the cap liner being vertical and also engaging the further rib in a sealing manner.

The peripheral portion of the cap liner may have a downwardly open U-shape for engaging the upper end of the container body, and the laterally outwardly facing circumferentially extending surface of the cap liner may have a surface of said U-shape.

BRIEF DESCRIPTION OF THE DRAWINGS

Embodiments of the present invention will now be described, by way of example, with reference to the accompanying drawings, of which.

DESCRIPTION OF PREFERRED EMBODIMENTS

Figure 1:
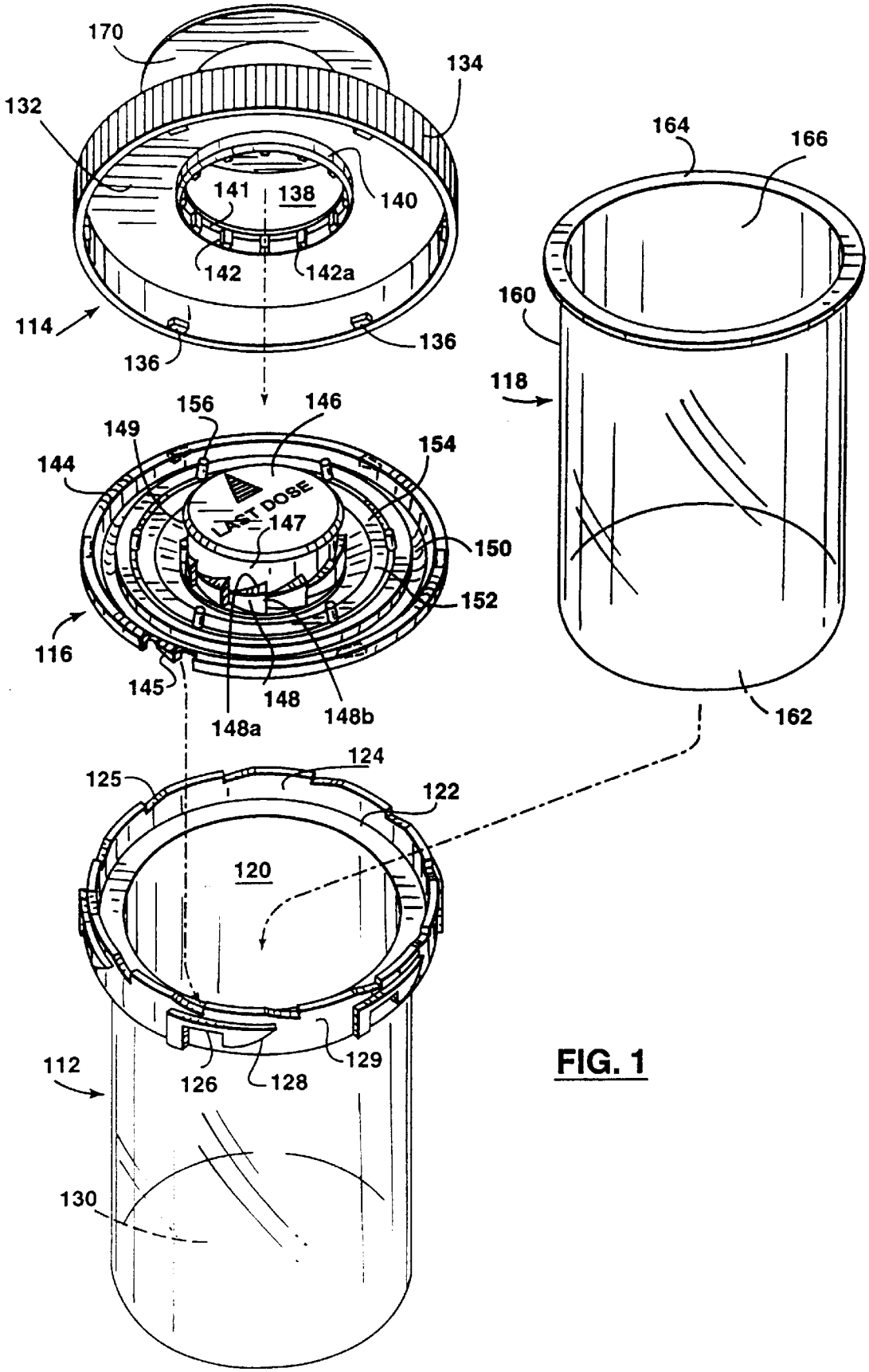
FIG. 1 is an exploded perspective view of a medication container in accordance with one embodiment of the invention.

Referring to the drawings, FIG. 1 shows a medication container having a tubular container body 112, a cap 114, a cap liner 116 and a disposable body liner 118. The container body 112 is of plastic material and has an open upper end 120 with a peripheral outwardly extending flange 122 and an upwardly extending wall 124 extending around the outer edge of the flange 122. The upper edge of the wall 124 has a circumferentially extending series of ratchet teeth 125, there being twelve such teeth in this embodiment. The external surface of the wall 124 has a series of circumferentially-spaced downwardly-opened recesses 126, each with an adjacent upwardly inclined ramp 128, and each ramp 128 being followed by a space 129, there being six such recesses in this embodiment. The lower end 130 of the container body 112 is closed.

The cap 114 is of plastic material and has a circular top portion 132 with a downwardly extending peripheral wall 134 having a series of circumferentially-spaced inwardly-projecting lugs 136 at its lower end equal in number to the number of recesses 126 in the external surface of the wall 124 at the upper end of the container body 112. The circular top portion 132 of the cap 114 also has a circular aperture 138 and a short downwardly extending inner wall 140 surrounding the aperture 138. The internal diameter of the inner wall 140 is slightly larger than the diameter of the central aperture 138 so as to provide an inner annular portion 141 of the circular top portion 138 projecting radially inwardly beyond the inner wall 140. The inner wall 140 has a series of circumferentially spaced vertical ribs 142 which extend radially inwardly from the inner wall 140 for a distance slightly less than the inner annular portion 141 of the circular top portion 132 of the cap 114, there being twelve such ribs 142 in this embodiment.

The cap liner 116 is of resilient plastic material and has a peripheral portion 144 of downwardly-open U-shape which receives and engages the upper end of the wall 124 of the container body 112 to close the upper end thereof. The peripheral portion 144 of the cap liner 116 has a series of circumferentially spaced downwardly extending projections 145 positioned to engage the ratchet teeth 125 on the upper edge of the wall 124 of the container body 112, there being six such projections in this embodiment. The cap liner 116 also has a central button portion 146 which projects upwardly through the central aperture 138 in the cap 114. The central button portion 146 has a series of ratchet teeth 148 extending around the lower portion of the exterior of the side wall 147 thereof, each tooth 148 having an inclined upper surface 148*a* engageable by the lower ends of the vertical ribs 142 on the cap 114, there being twelve such teeth in this embodiment.

The inclined upper surface 148*a* of each ratchet tooth 148 is both circumferentially upwardly inclined and also radially outwardly downwardly inclined. The lower end 142*a* of each rib 142 is inclined in a complementary manner for engagement with the inclined upper surfaces 148*a* of the ratchet teeth 148. The inclined upper surface 148*a* of each ratchet tooth 148 is followed by a vertical surface 148*b*. The topmost portion of the side wall 147 has an annular bead 149 extending therearound which is slightly larger in diameter than the diameter of the central aperture 138 in the cap 114. During assembly, the bead 149 is snapped through the aperture 138. The bead 149 may extend continuously around the topmost portion of the side wall 147 or may be interrupted.

Figure 6:
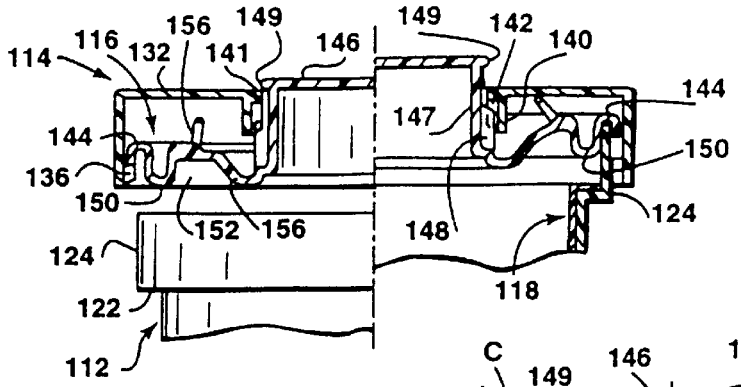
FIG. 6 is a side view, partly in section, of the cap and cap liner and the upper portion of the container body, with the left hand side of the figure showing the configuration of the cap liner before the cap contacts the container body, and with the right hand side of the figure showing the configuration of the cap liner when the cap has been secured to the container body.
Figure 7:
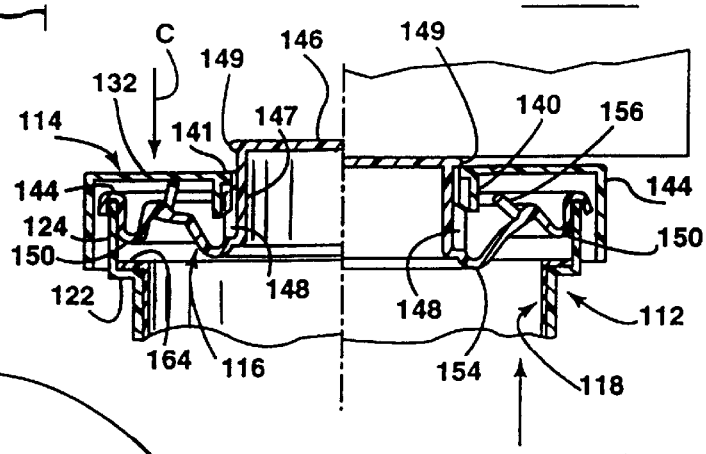
FIG. 7 is a similar view to FIG. 6, but with the left hand side of the figure showing the configuration of the cap liner when the cap is being removed without pushing down the central button of the cap liner, and with the right hand side of the figure showing the configuration of the cap liner when the cap is being removed with the central button of the cap liner first being depressed.

As shown. more clearly in FIGS. 6 and 7, the downwardly-open U-shaped peripheral portion 144 of the cap liner 116 merges with an outer U-shaped upwardly-open portion 150 which in turn merges with an intermediate downwardly-open U-shaped portion 152, which in turn merges with an inner upwardly-open U-shaped portion 154, which merges with the lower end of the side wall 147 of the central button portion 146. The intermediate downwardly-open U-shaped portion 152 has a series of circumferentially spaced posts 156 extending upwardly therefrom.

The disposable body liner 118 has a tubular body 160 which is a press fit in the container body 112, the tubular body 160 having a closed lower end 162 and a peripheral radially outwardly extending flange 164 at its upper open end 166.

The medication container also has an annular label 170 which can be secured to the central top portion 132 of the cap 114 so as to surround the aperture 138, as will be described in more detail later.

Figure 8:
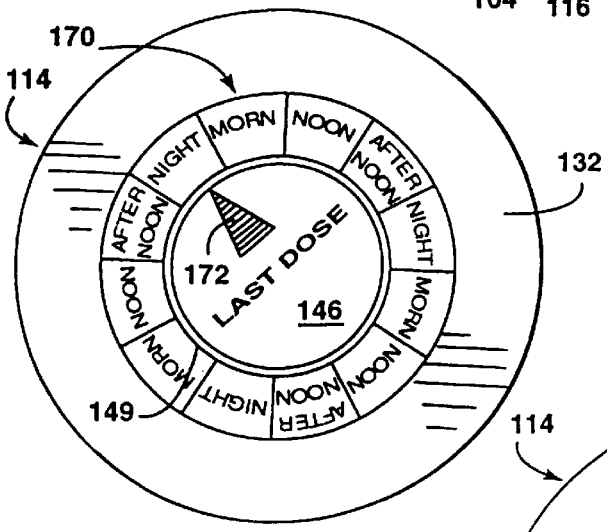
FIG. 8 is a plan view of the container before opening, with the "last dose" arrow being in the "night" position.
Figure 9:
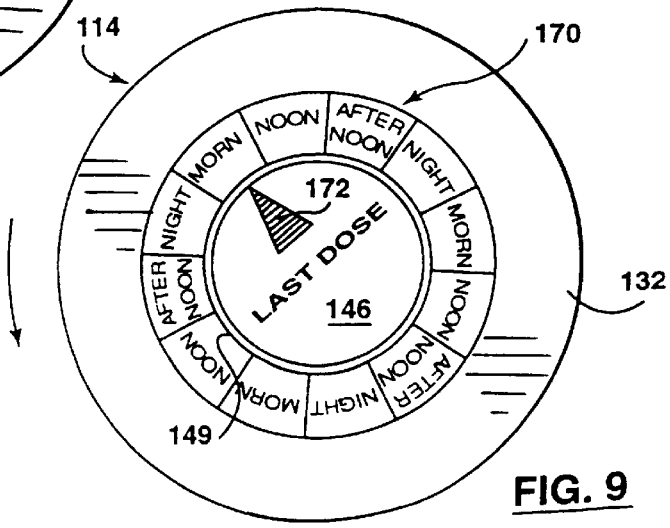
FIG. 9 is a similar view showing the cap subsequently rotated to the open position, with the "last dose" arrow having moved to the "morn" position (and remaining there when the cap has been rotated to the close position.

FIGS. 8 and 9 show the annular label 170, which is preferably a self-adhesive label, secured to the top of the circular portion 132 of the cap 114 so as to surround the central button 146 of the liner 116. As shown, the label 170 has various sectors showing dosage times. The top of the central button 146 bears the words LAST DOSE and an indicator arrow 172. Alternatively, this information may be on a label secured to the top of the central button 146.

Figure 2:
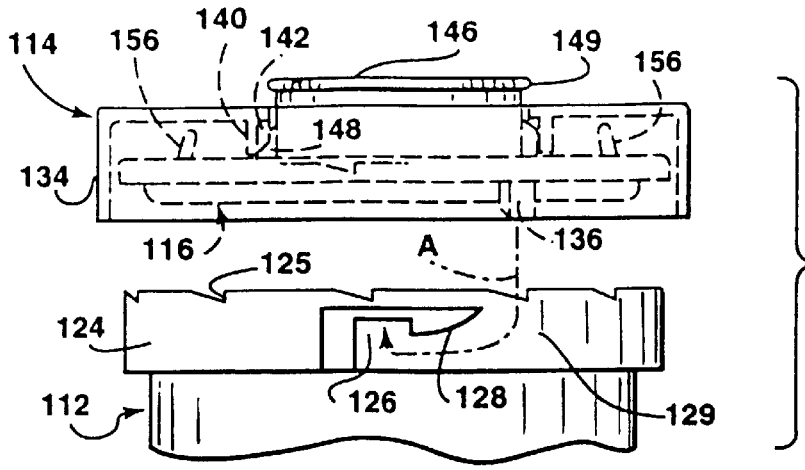
FIG. 2 is a diagrammatic side view of the cap positioned above the upper portion of the container body, with parts of the cap and the cap liner therein being shown in dotted outline.

FIG. 2 and the left hand side of FIG. 6 show the cap 114 and cap liner 116 before attachment to the container body 112. The cap liner 116 has been assembled with the cap 114 by snapping the outer peripheral portion 144 of the cap liner 166 past the lugs 136 on the cap 114, and also by snapping the peripheral bead 149 on the central button portion 146 of the cap liner 116 through the central aperture 138 in the cap 114 so that the central button portion 146 projects above the circular top portion 132 of the cap 114. The ribs 142 on the inner wall 140 of the cap 114 are then engaged with the ratchet teeth 148 on the lower part of the outer surface of the wall 147 of the central button portion 146 of the cap liner 116.

The cap liner 116 can move vertically a limited amount in the cap 114, with downward movement of the cap liner 116 in the cap 114 being limited by engagement of the button bead 149 with the inner annular portion 141 of the cap 114 and by the engagement of the outer edge of the outer peripheral portion 144 of the liner 116 with the lugs 136 on the inside of the peripheral wall 134 of the cap 114. Upward movement of the liner 116 relative to the cap 114 is limited by engagement of the liner 116 with the lower end of the wall 140 of the cap 114 and/or by the engagement of the posts 156 on the liner 116 with the underside of the circular top portion 132 of the cap 114 although, as will be described later, the liner 116 can be resiliently deformed to permit further downward movement of the cap 114 relative thereto.

The ribs 142 on the cap 114 are always engaged with the ratchet teeth 148 on the liner 116, regardless of the actual vertical position of the liner 116 in the cap 114, when the cap 114 is not on the container body 112 and the cap liner 116 is not deformed, so as to prevent the liner 116 from being able to "free wheel" relative to the cap 114 when the cap 114 is not on the container body. When the cap 114 is not on the container body 112, the cap liner 116 can be intentionally rotated in a clockwise manner relative to the cap 114 to set the arrow 172 on the central button 146 in the correct position relative to the annular label 170 on the cap 114. Rotation of the cap liner 116 in a clockwise manner relative to the cap 114 can be permitted and rotation of the cap liner 116 in an anti-clockwise manner relative to the cap 114 facilitated by pushing down on the central button 146 of the cap liner 116 to cause axial movement of the cap liner 116 relative to the cap 114 to disengage the inter-engaging mechanism.

Figure 3:
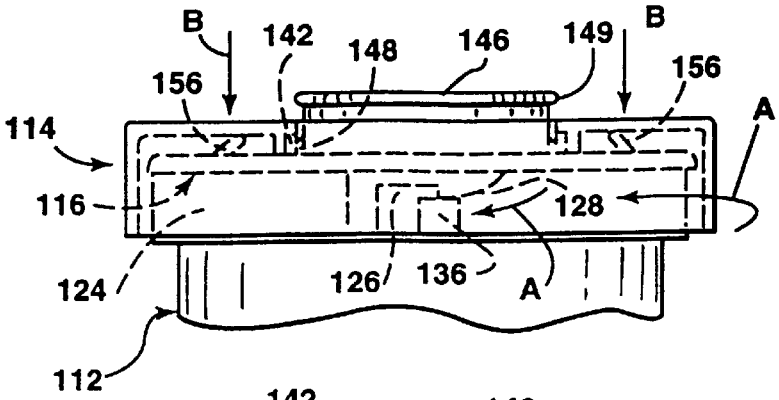
FIG. 3 is a similar view but showing the cap being secured to the container body.

To dose the container, the cap 114 with liner 116 is placed on top of the container body 112 and rotated clockwise relative thereto, with some downward pressure, as indicated by the arrows A and B in FIGS. 2 and 3, so that each lug 136 on the cap 114 (after passing into a space 129) engages a ramp 128 on the container body 112. During this portion of the closing movement, the outer downwardly open U-shaped portion 144 of the liner 116 engages the upper edge of the wall 124 of the container body 112, and continued downward pressure on the cap 114 causes the cap 114 to exert downward pressure on the liner posts 156 with consequent resilient deformation of the liner 116. Each lug 136 then moves into an adjacent recess 126, thereby permitting slight upward movement of the cap 114 relative to the container body 112 when downward pressure on the cap 114 is removed, such upward movement of the cap 114 being caused by engagement of the posts 156 with the top portion 132 of the cap 114. The bead 149 surrounding the upper end of the central button portion 146 is then spaced a pre-determined distance above the top of the cap 114.

Figure 4:
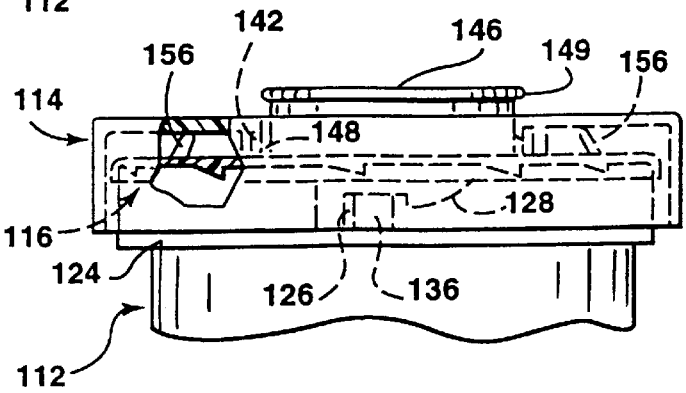
FIG. 4 is a similar view showing the cap secured to the container body.

As shown in FIG. 4 and the right hand side of FIG. 6, the engagement of the top portion 132 of the cap 114 with the posts 156 holds the outer peripheral portion 144 of the liner 116 firmly in engagement with the liner posts 156 so as to retain the outer peripheral portion 144 of the liner 116 in engagement with the upper edge of the wall 124 of the container body 112. Also, the outer side wall of the upwardly open U-shaped portion 150 of the cap liner 116 sealingly engages the inner surface of the peripheral wall 124 of the container body 112 to protect medication therein, as shown on the right hand side of FIG. 6.

During rotation of the cap 114 and liner 116 relative to the container body 112 when dosing the container, the ribs 142 on the cap 114 engage the vertical surfaces 148*b* of the ratchet teeth 148 to cause the liner 116 to rotate with the cap 114, that is to say there is no rotation of the cap 114 relative to the liner 116 during closing movement. The projections 145 in the outer peripheral portion 144 of the liner 116 slide past the ratchet teeth 125 on the top of the wall 124 of the container body 112 during such movement. FIG. 8 shows the top of the container when the cap 114 is in the closed position, with the indicator arrow 172 on the central button 146 of the liner 116 pointing to the "NIGHT" sector on the label 170, thus indicating that the last dose had been taken during the previous night.

The container can be opened in two ways, namely without pushing down on the central button 146 or with pushing down on the central button 146.

Figure 5:
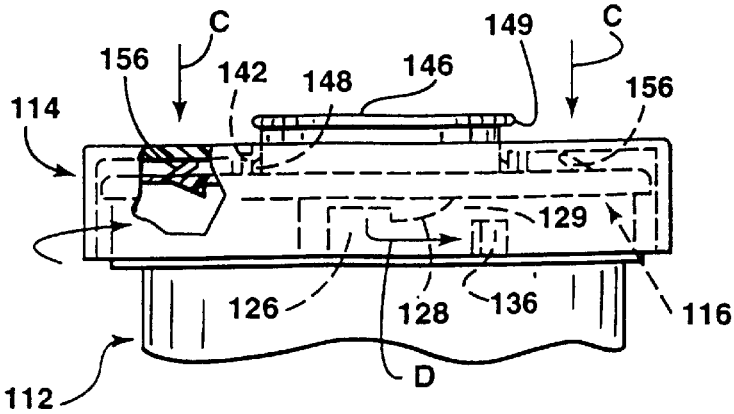
FIG. 5 is a similar view showing the cap being removed from the container body without pushing down on the central button of the cap.

To open the container without pushing down on the central button 146, as shown in FIG. 5 and the left hand side of FIG. 7, the cap 114 is pushed down (as indicated by the arrows C in these figures) a sufficient amount relative to the container body 112 to cause the cap lugs 136 to move downwardly out of the container recesses 126. The liner posts 156 are deflected to accommodate such downward movement of the cap 114. With the downward pressure maintained, the cap 114 is rotated anti-clockwise relative to the container body 112, as indicated by the arrow D in FIG. 5, to cause the cap lugs 136 to move laterally away from the recesses 126 and then past the adjacent ramps 128 to the spaces 129. The cap 114 can then be removed from the container body 112.

During this opening movement, the cap 114 is pushing the outer peripheral portion 144 of the liner 116 (through the posts 156) against the upper edge of the peripheral wall 124 of the container body 112. The projections 145 in the liner peripheral portion 144 engage the ratchet teeth 125 on the upper edge of the container peripheral wall 124 to prevent the liner 116 from rotating relative to the container body 112 while the cap 114 is being rotated in the anti-clockwise opening direction. The cap 114 therefore rotates relative to the liner 116 to cause the indicator arrow 172 on the central button 146 of the liner 116 to now point to the "MORN" sector, thereby indicating that the last dose was taken in the morning. Thus, indexing occurs when the container is being opened, not when it is being closed.

During the opening movement, the ribs 142 on the cap 114 snap past the ratchet teeth 148 on the annular wall 147 of the central button portion 146 of the liner 116. The snap of the cap ribs 142 past the liner ratchet teeth 148 during the opening movement produces a distinct "click", thereby indicating that the cap 114 has in fact been moved to the open position. The "click" is caused because the inclined lower ends 142*a* of the ribs 142 ride up the inclined upper surfaces 148*a* of the ratchet teeth 148 by depressing the central button portion 146 and resiliently deflecting adjacent portions of the liner 116 such that, when the lower ends 142*a* of the ribs 142 move past the upper surfaces 148*a* of the teeth 148, the central button portion 146 and adjacent deflected portions of the liner 110 snap back to their original position and configuration to cause the "click". This is an advantage over known containers of the kind which merely have cap lugs which engage in recesses in a container body and with which no such "click" occurs. It has been found that the previously described shaping (inclination) of the upper surfaces 148*a* of the ratchet teeth 148 and the lower ends 142*a* of the ribs 142 produce vertical and horizontal forces which facilitate the opening movement described above.

It should be noted that it is possible to omit the liner projections 145 and container ratchet teeth 125 in embodiments where the liner 116 is pushed with a sufficient force against the upper edge of the container wall 124 during opening movement such that the liner 116 is prevented from rotating relative to the container body 112.

As shown on the right hand side of FIG. 7, the container may alternatively be open by first pushing down on the central button 146, with consequent resilient deflection of the liner 116 independently of the cap 114 as shown. This permits the cap 114 to be easily moved downwardly relative to the container body 112, by gravity or by engagement of the bead 149 on the button 146 with the top of the cap 114, to release the lugs 136 from the recesses 126 for subsequent anti-clockwise rotation of the cap 114 relative to the container body 112 (and to the liner 116) as before. This manner of opening is advantageous in that it produces less friction between the cap 114 and the container body 112 because the ratchet teeth 148 on the central button 146 become partially disengaged from the ribs 142 on the cap 114 and the posts 156 become disengaged from the central portion 132 of the cap 114 to facilitate anti-clockwise rotation of the cap 114.

As previously mentioned, the body liner 118 is disposable. A predetermined amount of medication can be placed in a body liner 118 and the upper open end sealed by means of a removable seal (not shown), the nature of which will be readily apparent to a person skilled in the art, thereby providing pre-packaged medication which is tamper-evident. A pharmacist supplying the medication will leave the seal on when putting the pre-packed product in the container 112, so that the seal can subsequently be removed by the consumer who consequently knows that the correct amount of medication has been provided.

The bottom of the upwardly open U-shape portion 150 of the cap liner 116 may sealingly engage the flange 164 of the body liner 112 to protect the product therein. Also, the ratchet teeth 148 on the side wall 147 of the central button portion 146 of the cap 116 may be replaced by vertical ribs extending for the whole height of the side wall, with the ribs 142 on the interior of the inner wall 140 of the cap 114 being replaced by resiliently flexible projections engageable with the vertical ribs on the central button portion 146 to achieve the ratchet effect.

A medication identification label (not shown) may be attached to the tubular body 160 of the disposable body liner 118, with the container body 112 being transparent so that the label is visible therethrough. The label is also protected by the container body 112.

Although in the described embodiment the central button portion 146 normally projects above the top of the cap 114, the central button portion 146 (without a bead 149) may alternatively be level with or slightly below the top of the cap 114.

Figure 10:
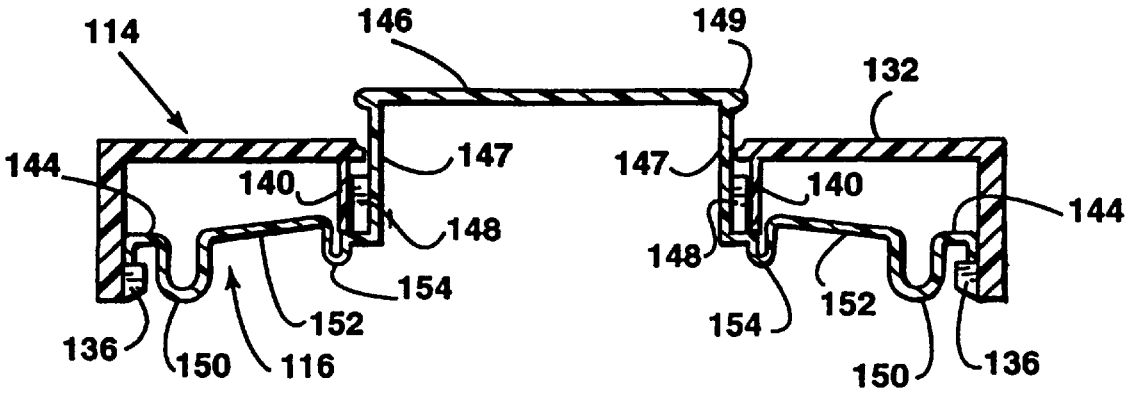
FIG. 10 is a sectional side view of a cap and cap liner in accordance with another embodiment of the invention, namely with the pins on the cap liner of the previous embodiment having been omitted.

As shown in FIG. 10, the posts 156 on the cap liner 116 may be omitted. In this case, the engagement which previously took place between the top portion 132 of the cap 114 and the posts 156 now occurs between the lower end of the inner wall 140 of the cap 114 and a circumferential ledge portion 155 on the cap liner 116 which extends radially outwardly of the ratchet teeth 148 at their lower ends.

Also, in the described embodiments, there are twelve ratchet teeth 148, twelve ribs 142, six lugs 136 and six recesses 126. As will be readily apparent to a person skilled in the art, the numbers of such parts may be varied in a manner which is consistent with the desired function thereof in accordance with the invention.

Figure 11:
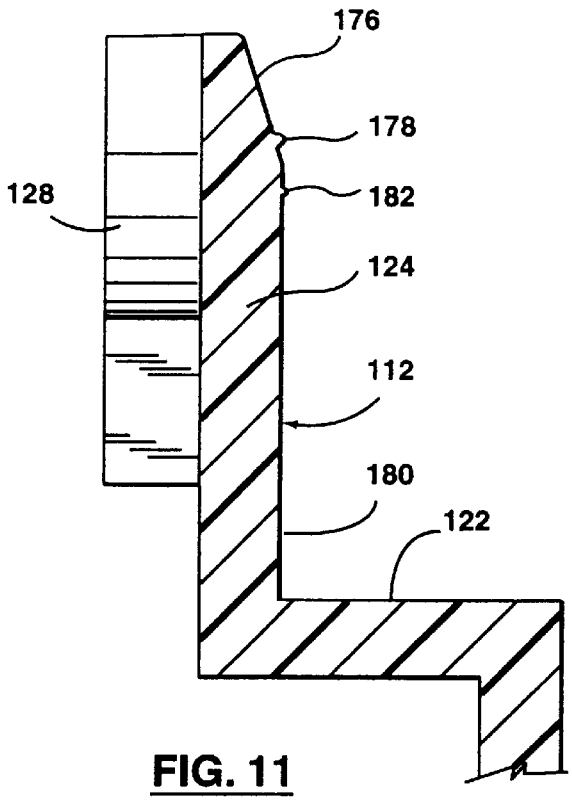
FIG. 11 is an enlarged fragmentary sectional view of the upper end of the container body showing the sealing ribs.
Figure 12:
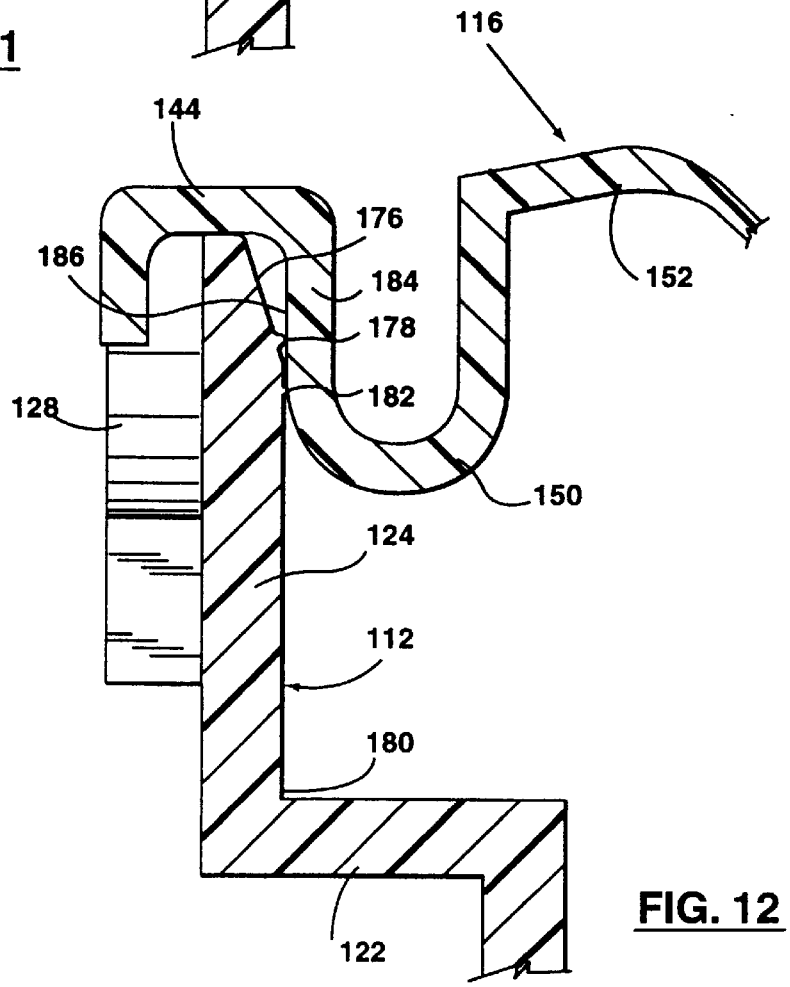
FIG. 12 is similar to FIG. 11 but also shows the cap liner in sealing engagement with the upper end of the container body.
Figure 13:
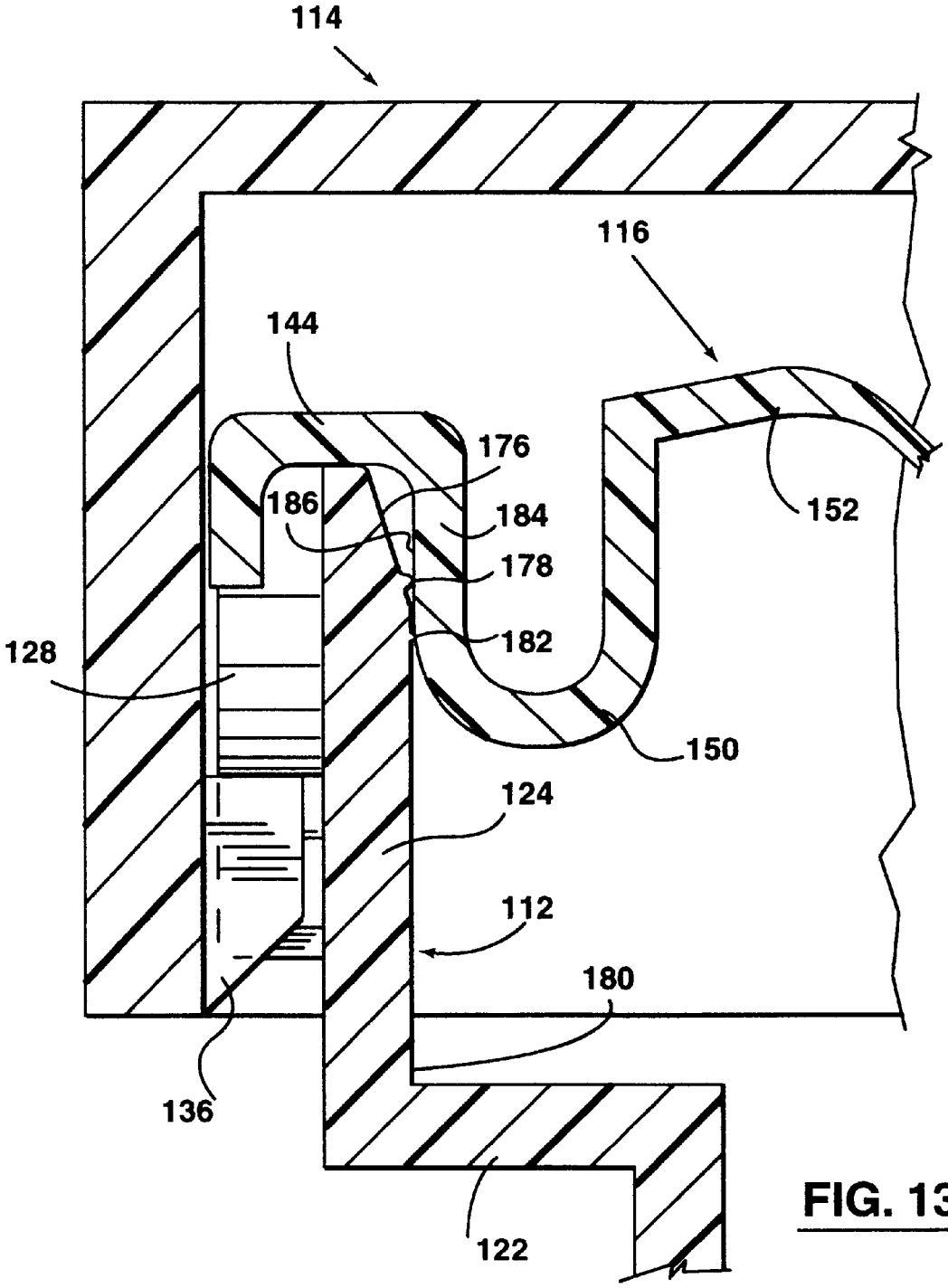
FIG. 13 is similar to FIG. 12 but also shows the cap in place on the top of the container body.

FIGS. 11 to 13 show how an effective seal can be provided between the cap liner 116 and the container body 112. The upper part of the wall 124 of the container body 112 has an inwardly facing and upwardly and radially outwardly inclined annular surface 176 with a laterally inwardly projecting rib 178 extending circumferentially therearound. Below the inclined annular surface 176, the inner surface 180 of the wall 124 is vertical. It will be noted that the rib 178 is located just above the junction of the inclined surface 176 and the vertical surface 180. The vertical surface 180 has a laterally inwardly projecting further rib 182 extending circumferentially therearound just below the junction of the inclined surface 176 and the vertical surface 182. The lengths of the ribs 178, 180 are such that they have free ends, i.e. radially inner ends, which are in the same vertical plane.

As previously mentioned, the cap liner 116 has a peripheral portion 144 of downwardly-open U-shape which receives and engages the upper end of the wall 124 of the container body 112 to close the upper end. The downwardly-open U-shaped peripheral portion 144 of the cap liner 116 emerges with an upwardly-open U-shaped portion 150. The wall 184 of the downwardly-open U-shaped portion 144 which merges with the upwardly-open U-shaped portion 150 has a laterally outwardly facing vertical surface 186 which, as shown in FIGS. 12 and 13, sealingly engages the ribs 178, 182 when the cap liner 116 is in the closed position on top of the container body 112 to seal the contents of the container body 112 from the external atmosphere. It has been found that the ribs 178, 182 provide an adequate sealing arrangement. In fact, the rib 178 can itself provide an effective seal, an advantage of the rib 178 being that it is located on the radially outwardly inclined surface 176.

The sealing arrangement described, particularly with respect to the rib 178 on the radially outwardly inclined surface 176, has the further advantage, in addition to providing an effective seal, that it accommodates rotational movement of the cap liner 116 relative to the container body 112 when the cap 114 and cap liner 116 are placed on the top of the container body 112 and rotated to the closed position.

Other embodiments of the invention will also be readily apparent to a person skilled in the art, the scope of the invention being defined in the appended claims.

I claim:

1. A medication container having:

a tubular container body with an upper open end, a cap detachably securable to the upper end of the container body by clockwise rotation relative thereto and removable from the container body by counter clockwise rotation relative thereto, a cap liner within the cap and having a peripheral portion engageable with the upper end of the container body to close the upper end, the cap liner rotating with the cap when the cap is rotated in one direction relative to the container body and remaining stationary relative to the cap when the cap is rotated in an opposite direction relative to the container body, the cap and the cap liner having indicia which indicates the next dosage time when the cap is rotated in the opposite direction, the upper end of the container body having a laterally inwardly facing and upwardly and laterally outwardly inclined annular surface with a laterally inwardly projecting rib extending circumferentially therearound, and the cap liner having a laterally outwardly facing circumferentially extending surface engaging the circumferentially extending rib of the upper end of the container body in a sealing manner.

2. Apparatus according to claim 1 wherein the upper end of the container body has a vertical annular surface immediately below the laterally outwardly inclined surface, the vertical annular surface having a laterally inwardly projecting further rib extending circumferentially therearound, and the laterally outwardly facing circumferentially extending surface of the cap liner being vertical and also engaging the further rib in a sealing manner.

3. A medication container according to claim 1 wherein the peripheral portion of the cap liner has a downwardly open U-shape for engaging the upper end of the container body, and the laterally outwardly facing circumferentially extending surface of the cap liner is a surface of said U-shape.

4. A medication container according to claim 3 wherein the upper end of the container body has a vertical annular surface immediately below the laterally outwardly inclined surface, and said surface of said U-shape of the cap liner engages said vertical annular surface as well as the circumferentially extending rib on the laterally outwardly inclined surface.

* * * * *